US009949560B2

(12) United States Patent
Nakamura et al.

(10) Patent No.: US 9,949,560 B2
(45) Date of Patent: Apr. 24, 2018

(54) COSMETIC FILAMENT, COSMETIC BRUSH BRISTLE MATERIAL USING SAME FILAMENT, AND COSMETIC BRUSH USING SAME BRISTLE MATERIAL

(75) Inventors: Kenji Nakamura, Osaka (JP); Koji Nakamura, Osaka (JP)

(73) Assignees: Kenji Nakamura, Osaka (JP); Koji Nakamura, Osaka (JP)

( * ) Notice: Subject to any disclaimer, the term of this patent is extended or adjusted under 35 U.S.C. 154(b) by 114 days.

(21) Appl. No.: 14/004,589

(22) PCT Filed: Apr. 7, 2011

(86) PCT No.: PCT/JP2011/058769

§ 371 (c)(1),
(2), (4) Date: Sep. 17, 2013

(87) PCT Pub. No.: WO2012/137328

PCT Pub. Date: Oct. 11, 2012

(65) Prior Publication Data

US 2014/0020197 A1 Jan. 23, 2014

(51) Int. Cl.

| | |
|---|---|
| ***A46D 1/00*** | (2006.01) |
| ***D01F 6/62*** | (2006.01) |
| ***D01F 1/10*** | (2006.01) |

(52) U.S. Cl.

CPC ..... *A46D 1/0261* (2013.01); *A46D 1/0207* (2013.01); *D01F 1/10* (2013.01); (Continued)

(58) Field of Classification Search

CPC ..... A46B 2200/00; A46B 2200/10; A46B 2200/1046; A46B 2200/1053; (Continued)

(56) References Cited

U.S. PATENT DOCUMENTS 5,679,067 A * 10/1997 Johnson et al. ..... 451/527
5,903,951 A * 5/1999 Lonta et al. ..... 15/180
(Continued)

FOREIGN PATENT DOCUMENTS

EP 1496086 A1 1/2005
EP 2123189 A1 * 11/2009 ..... A46D 1/0238
(Continued)

OTHER PUBLICATIONS

DuPont Crastin 6129 NC010 Thermoplastic Polyester resin 2015.*
(Continued)

*Primary Examiner* — Peter Y Choi
*Assistant Examiner* — Jennifer A Gillett
(74) *Attorney, Agent, or Firm* — Law Office of Katsuhiro Arai

(57) ABSTRACT

A filament for cosmetic brush is constituted by a polyester resin filament having many projections over its entire surface, wherein the polyester resin is polytrimethylene terephthalate and/or polybutylene terephthalate, the polyester resin contains glass particles of 1 to 2 μm in average particle size by 0.3 to 1.0 percent by weight as the inorganic particles, the thermal conductivity of the glass particle is in a range of 5 to 7 times that of the resin, and the projections are formed over the entire surface of the cosmetic filament by the glass particles covered with the resin.

10 Claims, 3 Drawing Sheets

(52) U.S. Cl.
CPC ..... *D01F 6/62* (2013.01); *A46B 2200/1046* (2013.01); *Y10T 428/2927* (2015.01)

(58) Field of Classification Search
CPC ..... A46B 2200/106; A46B 9/00; A46B 9/02; A46B 9/021; Y10T 428/2913; Y10T 428/2937; Y10T 428/2976; Y10T 428/2978; Y10T 428/2964; Y10T 428/2967; Y10T 428/2969
See application file for complete search history.

(56) References Cited

U.S. PATENT DOCUMENTS

| | | | | |
|---|---|---|---|---|
| 5,983,434 | A * | 11/1999 | Eichinger et al. | 15/180 |
| 6,174,600 | B1 * | 1/2001 | Brown | A46D 1/00 15/159.1 |
| 6,352,471 | B1 * | 3/2002 | Bange et al. | 451/527 |
| 6,623,200 | B1 * | 9/2003 | Gueret | A45D 34/046 15/207.2 |
| 7,752,702 | B2 * | 7/2010 | Nakamura et al. | 15/207.2 |
| 2006/0088711 | A1 * | 4/2006 | Nakamura | A46D 1/00 428/364 |
| 2008/0100126 | A1 * | 5/2008 | Kwon | A46B 9/028 300/21 |
| 2008/0280541 | A1 * | 11/2008 | Chou et al. | 451/59 |
| 2014/0020197 | A1 * | 1/2014 | Nakamura et al. | 15/160 |

FOREIGN PATENT DOCUMENTS

| | | | | |
|---|---|---|---|---|
| EP | 2530120 | A1 | | 12/2012 |
| JP | 2005-130914 | A | | 5/2005 |
| JP | 2006-141991 | A | | 6/2006 |
| JP | 2006141991 | A | * | 6/2006 |
| JP | 2006158842 | A | * | 6/2006 |
| JP | 2007167297 | A | * | 7/2007 |
| JP | 2008-109990 | A | | 5/2008 |
| JP | 2009-285445 | A | | 12/2009 |
| WO | 01/38615 | A1 | | 5/2001 |
| WO | 2005/039353 | A1 | | 5/2005 |

OTHER PUBLICATIONS

Thermal Conductivity, undated.*
JP 2009285445 English Table translation. Translated by Steve Spar. Mar. 2016.*
Notification of Transmittal of Translation of the International Preliminary Report on Patentability (PCT/IB/338) dated Nov. 14, 2013, with International Preliminary Report on Patentability (PCT/IB/373) and Written Opinion of the International Searching Authority (PCT/ISA/237), for corresponding international application PCT/JP2011/058769.
International Search Report (ISR) dated Jul. 12, 2011, issued for International application No. PCT/JP2011/058769.
Extended European Search Report (EESR) dated Jul. 25, 2014, issued in corresponding European Application No. EP11863175.3.

* cited by examiner

[Fig. 1]
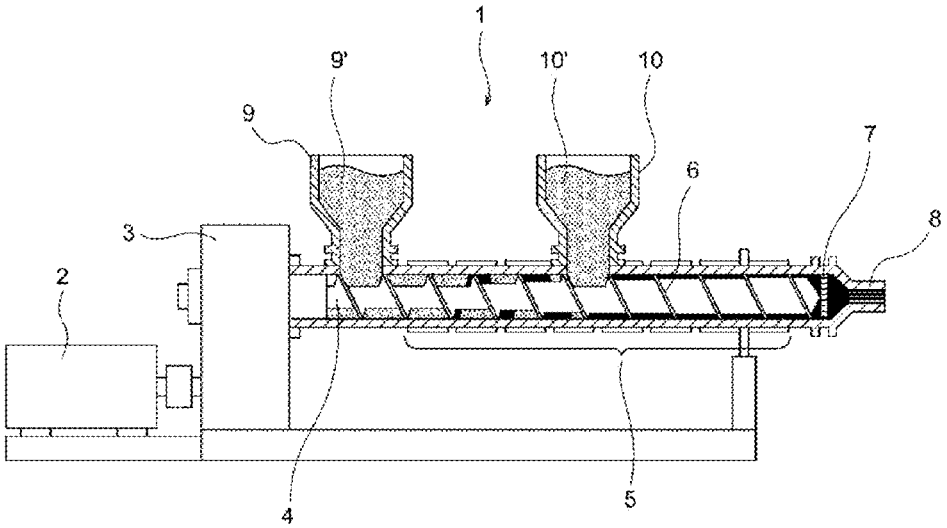
[Fig. 2]
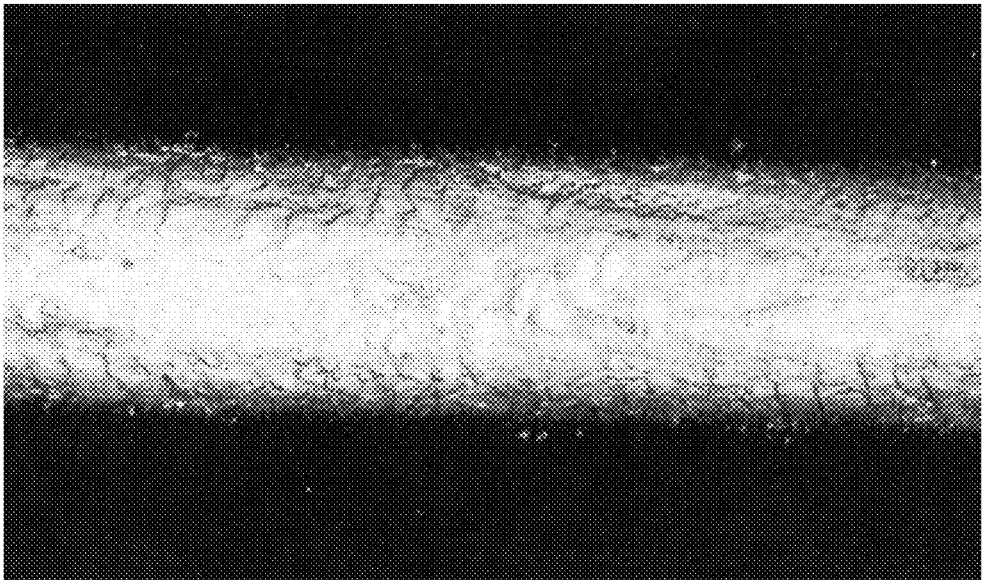

[Fig. 3]
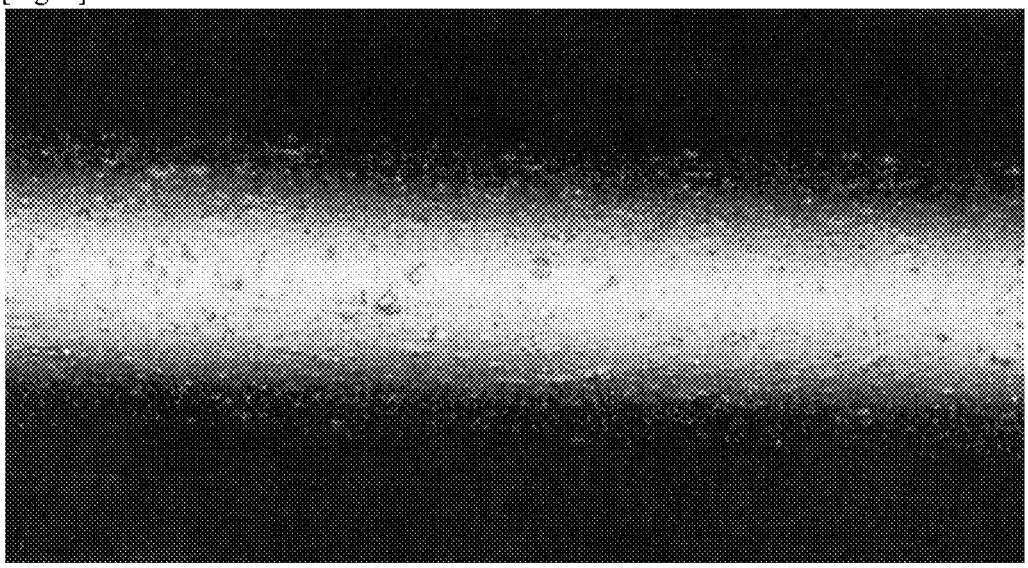
[Fig. 4]
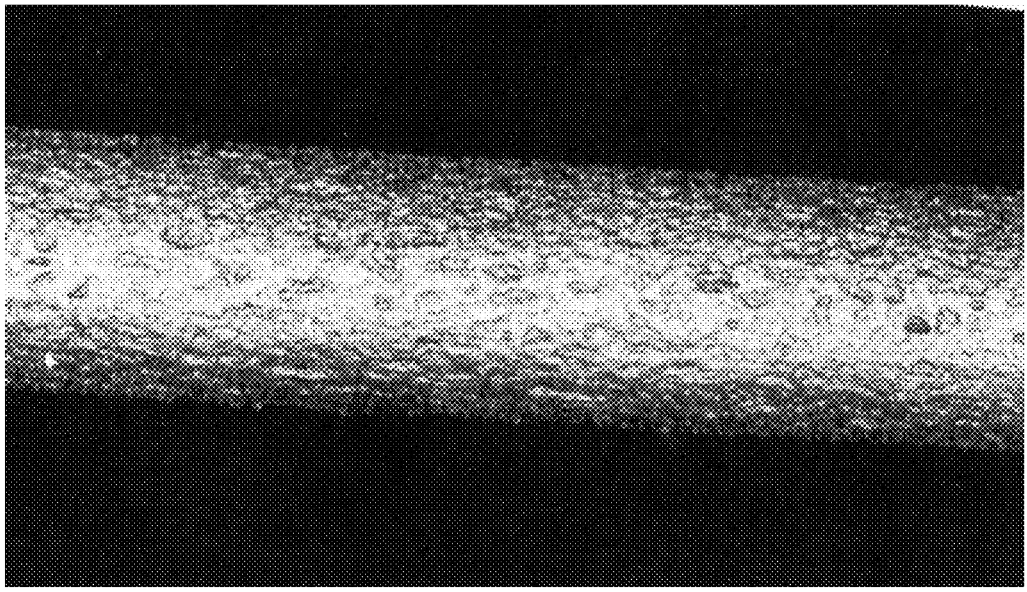

[Fig. 5]
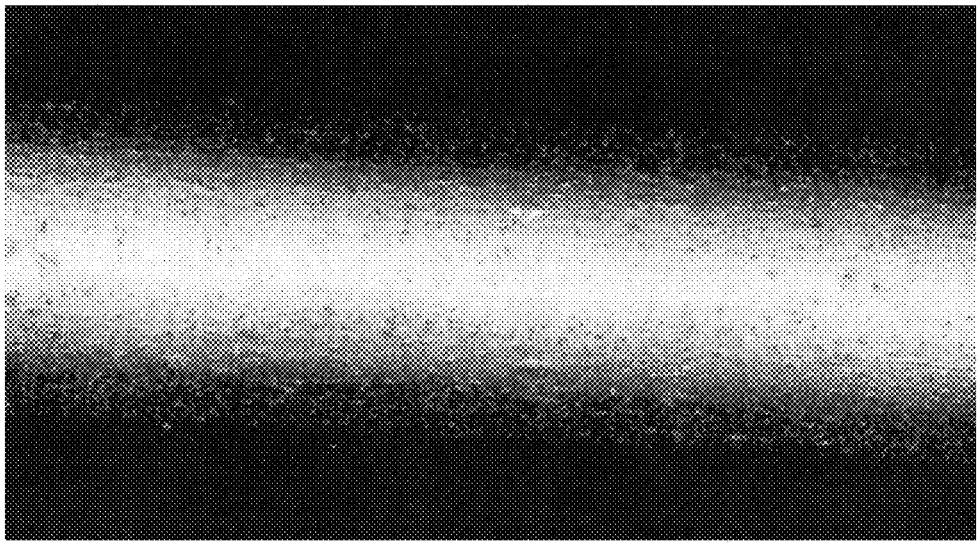
[Fig. 6]
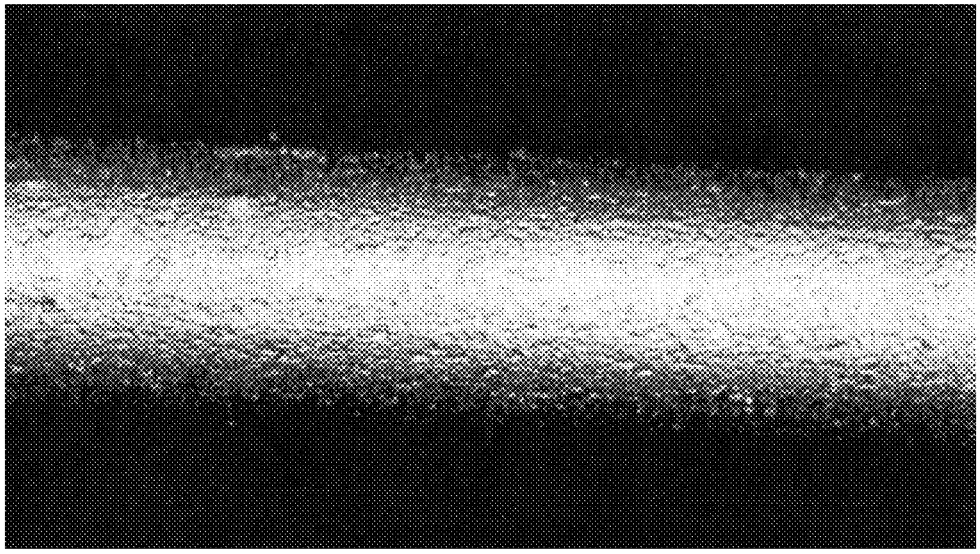
[Fig. 7]
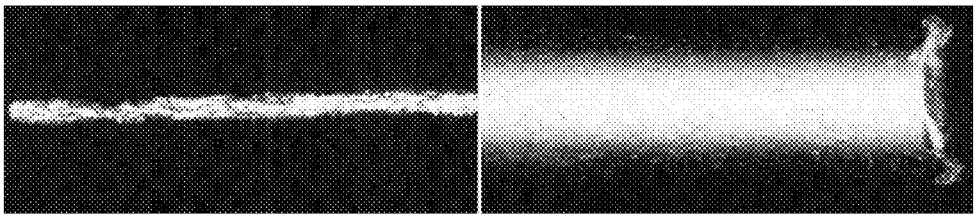

COSMETIC FILAMENT, COSMETIC BRUSH BRISTLE MATERIAL USING SAME FILAMENT, AND COSMETIC BRUSH USING SAME BRISTLE MATERIAL

This application is the U.S. National Phase under 35 U.S.C. § 371 of International Application PCT/JP2011/058769, filed Apr. 7, 2011. The International Application was published under PCT Article 21(2) in a language other than English.

TECHNICAL FIELD

The present invention relates to a cosmetic filament made of polyester resin, cosmetic brush bristle material using such cosmetic filament, and cosmetic brush using such bristle material, and more specifically to a cosmetic filament made of polyester resin containing glass particles, cosmetic brush bristle material using such cosmetic filament whose surface has been roughened by alkali treatment, and cosmetic brush using such bristle material that offers excellent loading property (ease of picking up and holding), transfer property, and feeling of use with respect to cosmetic material.

BACKGROUND ART

Cosmetic brushes have traditionally used horse hair, goat hair and other animal hair, and these animal-hair bristles are believed to feel pleasant on the skin, or in other words feel good when used, and also offer good loading property (ease of picking up and holding) with respect to powder and other cosmetic materials, as well as good transfer property in transferring cosmetic materials onto the skin. Accordingly, various horse-hair cosmetic brushes are available on the market. The photograph in FIG. 2 is an image of the surface of a horse's axillary tail hair taken by a laser microscope (VK-Analyzer VK-8710 by Keyence), and clearly many projections are found on the surface of the horse hair. These many projections are believed to explain the good loading property and transfer property of horse hair with respect to powder and other cosmetic materials.

Having the aforementioned advantages, however, animal hair has drawbacks, such as being a natural resource and therefore limited in supply. For this reason, cosmetic brush bristle materials made of synthetic fibers have been proposed in recent years as substitutes for animal hair.

For example, Patent Literature 1 proposes a cosmetic brush bristle material having concaves on the surface. One hundred parts by weight of polybutylene terephthalate (PBT) are mixed with 5 to 15 parts by weight of silica, talc, silver zeolite, or other inorganic powder whose average particle size is 0.5 to 1.0 μm, after which the mixture is melted and spun into a filament and the obtained filament is drawn to 5 to 6 times longer to cause the aforementioned inorganic powder to sink and thereby form concaves on the surface. A bundle of such filaments is cut to a specific length and one end of the obtained fiber bundle is soaked in an alkali solution to enlarge the aforementioned concaves, while the other end is melted to reduce weight and formed into a tapered shape, to produce the proposed cosmetic brush bristle material (refer to Patent Literature 1). It is disclosed that a cosmetic brush bristle material using the aforementioned filament having concaves formed on it provides loading property and transfer property equivalent to those of animal hair because the concaves formed on the filament surface and enlarged by alkali treatment act like cuticles of animal hair.

Patent Literature 2 proposes a brush bristle material having surface irregularities. It is disclosed that, to taper the tip of this brush bristle material, polytrimethylene terephthalate (PTT) is melted and spun into a filament and the obtained filament is drawn to 5 to 6 times longer, and one end of a bundle of such filaments is soaked by approx. 10 to 20 mm in the length direction in an alkali treatment solution containing amine catalyst and treated for 1 to 2 hours at 110 to 130° C., to form surface irregularities of 1 to 20 μm at the tapered tip of the filament as a result of alkali treatment, without having to blend an inorganic powder (refer to Patent Literature 2). With the cosmetic brush bristle materials in Examples 1 and 2, the fineness of the PTT filament is 80 dtex for the former and 100 dtex for the latter.

BACKGROUND ART LITERATURE

Patent Literature

[Patent Literature 1] Japanese Patent Laid-open No. 2008-109990

[Patent Literature 2] Japanese Patent Laid-open No. 2006-141991

SUMMARY OF THE INVENTION

Problems to be Solved by the Invention

The aforementioned photograph of the surface of a horse hair (FIG. 2) shows many projections over the entire surface. Presence of these projections suggests that, if projections are formed over the entire surface of a polyester resin filament and then alkali-treated to form on one end of the filament those shapes similar to the many projections horse hair has, then a cosmetic brush offering good loading property and transfer property with respect to powder and other cosmetic materials just like horse-hair-based cosmetic brush bristle materials can be produced.

The cosmetic brush bristle materials made of polyester resin filaments as described in Patent Literatures 1 and 2 are such that one end of the filament is tapered by means of alkali treatment. However, the PBT filament in Patent Literature 1 is made by mixing 5 to 15 parts by weight of inorganic powder into PBT and then drawing the filament by 5 to 6 times, and therefore the filament may break unless the drawing speed, temperature and other conditions are strictly controlled in the drawing process. Additionally, since concaves are formed on the filament surface as a result of alkali treatment, the brush bristle material may break in the region at the tapered section where concaves face each other. Also, the cosmetic brush bristle materials described in Patent Literature 2 have a fineness of 80 dtex (3.43 mills (1 mill=1/1000 inch)) and 100 dtex (3.84 mills), respectively. Accordingly, providing irregularities of 20 μm or less on one end of each such filament in the thickness direction by means of alkali treatment may cause the filament to break in the region at the tapered section where concaves face each other. Also, both of the cosmetic brush bristle materials have concaves or irregularities at the tapered tip of their polyester resin filament, and as these shapes are different from the projections that horse-hair-based cosmetic brush bristle materials have, it is difficult to fabricate a product having functions similar to those of horse-hair-based cosmetic brush bristle materials.

Accordingly, the object of the present invention, which was developed in light of the situations described above, is to provide: a cosmetic brush filament constituted by a polyester resin filament having many projections formed over its entire surface; a cosmetic brush bristle material made by alkali-treating such cosmetic brush filament to form many projections on the surface of the tapered tip on one end and thereby prevent breakage in the region at the tapered tip; and a cosmetic brush using such cosmetic brush bristle material that offers good feeling during use as well as good loading property and transfer property with respect to powder and other cosmetic materials just like horse-hair cosmetic brushes.

Means for Solving the Problems

After studying repeatedly in earnest to achieve the aforementioned object, the inventors of the present invention completed the cosmetic brush proposed by the present invention based on the discoveries that: by using a polyester resin containing glass particles whose thermal conductivity is 5 to 7 times that of the resin by 0.3 to 1.0 percent by weight, a cosmetic bush filament constituted by a polyester resin filament having many projections formed over its entire surface can be manufactured; alkali treatment produces a region on one end of the filament where projections are formed by the glass particles covered with the resin, as well as regions covering the body and tapered tip, which are contiguous with the above region, where projections are formed by the glass particles over the entire surface, and breakage does not occur in the region at the tapered tip; and furthermore a cosmetic brush using such bristle material offers good feeling during use as well as good loading property and transfer property with respect to powder and other cosmetic materials just like horse-hair cosmetic brushes.

In other words, the present invention is described as follows:

The cosmetic filament pertaining to Embodiment 1 is a cosmetic filament made of polyester resin containing inorganic particles, characterized in that: the polyester resin is polytrimethylene terephthalate and/or polybutylene terephthalate; the polyester resin contains glass particles of 1 to 2 μm in average particle size by 0.3 to 1.0 percent by weight as the inorganic particles; the thermal conductivity of the glass particles is in a range of 5 to 7 times that of the resin; and projections are formed over the entire surface of the cosmetic filament by the glass particles covered with the resin.

The cosmetic filament pertaining to Embodiment 2 is characterized in that the thermal conductivity of the glass particle is 1.38 to 1.50 W/mK.

The cosmetic filament pertaining to Embodiment 3 is characterized in that the glass particle is made of E glass, silica glass, or silver glass.

The cosmetic filament pertaining to Embodiment 4 is characterized in that the fineness of the cosmetic filament is 2 to 4 mills.

The cosmetic brush bristle material pertaining to Embodiment 5 is a cosmetic brush bristle material having a body and tapered tip formed by alkali treatment on one end of a cosmetic filament constituted by polyester resin containing inorganic particles, characterized in that: the polyester resin is polytrimethylene terephthalate and/or polybutylene terephthalate; the polyester resin contains glass particles of 1 to 2 μm in average particle size by 0.3 to 1.0 percent by weight as the inorganic particles; the thermal conductivity of the glass particle is in a range of 5 to 7 times that of the resin; and the cosmetic filament has a region where projections are formed over the entire surface by the glass particles covered with the resin, and also has regions covering the body and tapered tip, which are contiguous with the above region, where projections are formed by the glass particles over the entire surface.

The cosmetic brush bristle material pertaining to Embodiment 6 is characterized in that projections of 1.0 to 1.5 μm in height are formed by the glass particles over the entire surface of the body.

The cosmetic brush bristle material pertaining to Embodiment 7 is characterized in that the thermal conductivity of the glass particles is 1.38 to 1.50 W/mK.

The cosmetic brush bristle material pertaining to Embodiment 8 is characterized in that the glass particles are made of E glass, silica glass, or silver glass.

The cosmetic brush bristle material pertaining to Embodiment 9 is characterized in that the diameter of the tapered tip is in a range of 10 to 25 μm.

The cosmetic brush bristle material pertaining to Embodiment 10 is characterized in that the distribution density of projections on the body of the cosmetic brush bristle material is in a range of 20 to 65 projections per 50 $\mu m^2$.

The cosmetic brush bristle material pertaining to Embodiment 11 is characterized in that the fineness of the cosmetic filament is 2 to 4 mills.

The cosmetic brush bristle material pertaining to Embodiment 12 is characterized in that the bacteriostatic activity of the cosmetic brush bristle material whose glass particles are made of silver glass is in a range of 4 to 6.

The cosmetic brush pertaining to Embodiment 13 is a cosmetic brush that uses a cosmetic brush bristle material having a body and tapered tip formed by alkali treatment on one end of a cosmetic filament constituted by polyester resin containing inorganic particles, characterized in that: the polyester resin is polytrimethylene terephthalate and/or polybutylene terephthalate; the polyester resin contains glass particles of 1 to 2 μm in average particle size by 0.3 to 1.0 percent by weight as the inorganic particles; the thermal conductivity of the glass particle is in a range of 5 to 7 times that of the resin; the cosmetic filament has a region where projections are formed over the entire surface by the glass particles covered with the resin, and also has regions covering the body and tapered tip, which are contiguous with the above region, where projections are formed by the glass particles over the entire surface; and the cosmetic brush bristle material used for such brush in which the regions covering the body and tapered tip are used to apply cosmetic materials is applied to a foundation brush, powder brush, eye shadow brush, lip brush or shadow brush.

The cosmetic brush pertaining to Embodiment 14 is characterized in that projections of 1.0 to 1.5 μm in height are formed by the glass particles over the entire surface of the body.

The cosmetic brush pertaining to Embodiment 15 is characterized in that the thermal conductivity of the glass particles is 1.38 to 1.50 W/mK.

The cosmetic brush pertaining to Embodiment 16 is characterized in that the glass particles are made of E glass, silica glass, or silver glass.

The cosmetic brush pertaining to Embodiment 17 is characterized in that the diameter of the tapered tip is in a range of 4 to 15 μm.

The cosmetic brush pertaining to Embodiment 18 is characterized in that the distribution density of projections on the body is in a range of 20 to 65 projections per 50 $\mu m^2$.

The cosmetic brush pertaining to Embodiment 19 is characterized in that the fineness of the cosmetic filament is 2 to 4 mills.

The cosmetic brush pertaining to Embodiment 20 is characterized in that the bacteriostatic activity of the cosmetic brush bristle material whose glass particles are made of silver glass is in a range of 4 to 6.

Effects of the Invention

The cosmetic filament proposed by the present invention is such that, by using a polyester resin such as PTT and/or PBT that contains, by 0.3 to 1.0 percent by weight, glass particles whose thermal conductivity is 5 to 7 times that of the resin, a cosmetic filament having projections formed over its entire surface by the glass particles covered with the resin can be manufactured.

The cosmetic brush bristle material proposed by the present invention is such that, with alkali treatment, a brush bristle material can be produced where the cosmetic filament has a region on one end where projections are formed over the entire surface of the cosmetic filament by the glass particles covered with the resin, and also has regions covering the body and tapered tip, which are contiguous with the above region, where projections are formed by the glass particles over the entire surface, and breakage does not occur in the region at the tapered tip. In particular, many projections of 1.0 to 1.5 μm in height can be formed by the glass particles over the entire surface of the body.

In addition, the cosmetic brush using the cosmetic bush bristle material as proposed by the present invention offers good feeling during use as well as good loading property and transfer property with respect to powder and other cosmetic materials just like horse-hair cosmetic brushes.

Furthermore, the cosmetic brush bristle material and cosmetic brush containing silver glass particles by 0.3 to 1.0 percent by weight offer excellent antibacterial property and deodorizing property, because projections of silver glass exist over the entire surface of the bristle material.

BRIEF DESCRIPTION OF THE DRAWINGS

FIG. 1 This is a longitudinal section view of an extrusion machine used to form pellets containing glass particles as the material for a cosmetic brush bristle material conforming to the present invention.

FIG. 2 This is a photograph of the surface of an auxiliary horse hair.

FIG. 3 This is a photograph of the surface of the body of a 3-mill filament constituted by PTT containing glass particles by 1 percent by weight.

FIG. 4 This is a photograph of the surface of the alkali-treated body of a 3-mill filament constituted by PTT containing glass particles by 1 percent by weight.

FIG. 5 This is a photograph of the surface of the body of a 3-mill filament constituted by PTT containing glass particles by 0.5 percent by weight.

FIG. 6 This is a photograph of the surface of the alkali-treated body of a filament constituted by PTT containing glass particles by 0.5 percent by weight.

FIG. 7 In FIG. 7, the photograph on the right shows the surface of the alkali-treated body of a 3-mill filament constituted by PTT containing glass particles by 1 percent by weight, while the photograph on the left shows the surface of the alkali-treated tapered tip of the above filament.

DESCRIPTION OF THE SYMBOLS

1 Extrusion machine
2 Motor
3 Gear reducer
4 Screw
5 Heater/blower
6 Screw thread
7 Breaker plate
8 Nozzle die
9 First hopper
9' Pellets
10 Second hopper
10' E glass powder

MODE FOR CARRYING OUT THE INVENTION (Thermoplastic Resin)

Polyester resins that can be used for the cosmetic brush bristle material include polytrimethylene terephthalate (hereinafter referred to as "PTT") and polybutylene terephthalate (hereinafter referred to as "PBT") from the viewpoints of physical properties such as flexibility, elastic recovery and water resistance. PTT may be used on its own, PTT and PBT may be blended, or PBT may be used on its own.

(Glass Particles)

Glass particles that can be contained in the resin used for the cosmetic brush bristle material include those made of E glass, silver glass, and silica glass. The thermal conductivity of E glass is 1.50 W/mK, while that of silver glass varies around 1.40 W/mK depending on the blended material(s). The silver glass used in the examples has a thermal conductivity of 1.40 W/mK. Also, the thermal conductivity of quartz glass is 1.38 W/mK, but it varies from 1.38 W/mK depending on the blended material(s).

Glass particles are blended with the polyester resin by 0.3 to 1.0 percent by weight. If the blending ratio is 0.3 percent by weight or less, the heights of glass particles projecting over the entire surface of the tapered part of the filament become 1.0 μm or less, which is not preferable. If the blending ratio is 1.0 percent by weight or more, on the other hand, the filament may break during the drawing process. As a result, preferably glass particles are blended with the resin at a blending ratio in a range of 0.3 to 1.0 percent by weight.

Note that manufacturing methods for E glass, silica glass, and silver glass are well known and therefore not explained.

(How to Manufacture Pellets Containing Glass Particles)

First, how to manufacture pellets constituted by the resin containing glass particles, as the material for the cosmetic brush bristle material proposed by the present invention, is explained.

The pellets are manufactured using the conventional extrusion machine shown in FIG. 1, equipped with two types of hoppers.

Reference numeral 1 represents an extrusion machine, 2 represents a motor, 3 represents a gear reducer, 4 represents a screw, 5 represents a heater/blower, 6 represents a screw thread, 7 represents a breaker plate, 8 represents a nozzle die, 9 represents a first hopper, 9' represents pellets, 10 represents a second hopper, and 10' represents E glass powder.

The extrusion machine 1 has two hoppers into which to introduce the supplied materials, or specifically the resin pellets 9' and E glass powder 10'. The hoppers of the extrusion machine 1 shown in FIG. 1 are referred to as the first hopper 9 and second hopper 10 from the left, and the resin pellets 9' are introduced to the first hopper 9, while the glass particles 10' are introduced to the second hopper 10 provided near the center of the extrusion machine. The position of the second hopper 10 is where the pellets 9' supplied into a screw barrel by the first hopper 9 are in a molten state as a result of being kneaded and transferred by the screw 4.

An appropriate weight of pellets 9' to be supplied is measured according to the specified blending ratio of the resin and glass particles and introduced into the first hopper 9, after which the pellets 9' are kneaded and transferred by the screw 4 and melted by the heater, at which position, or specifically at the position where the second hopper is placed, the weighed glass particles 10' to be supplied are introduced into the second hopper. The molten resin is kneaded with the glass particles 10' introduced in it and the mixture is extruded to form a molding containing glass particles 10', which is then cut to obtain pellets containing glass particles 10'. The temperature of the heater is determined according to the melting point of the resin used.

It should be noted that the extrusion machine in FIG. 1 has the same structure as that of any conventional extrusion machine except for the hopper structure, and therefore the structure of the extrusion machine in FIG. 1 is not explained.

(How to Manufacture Cosmetic Brush Bristle Material)

Next, how to manufacture the cosmetic brush bristle material proposed by the present invention is explained.

The filament of the cosmetic brush bristle material is manufactured by melting and spinning pellets containing glass particles. The pellets containing glass particles are dried and introduced to a spinning machine where they are melted, kneaded, extruded, and spun into a yarn from a spinning outlet, after which the yarn is drawn to 4 to 5 times longer through three stages of heating and drawing to manufacture a 3-mill filament. This filament has projections formed over its entire surface by the glass particles covered with polyester resin. Then, multiple filaments thus produced are bundled into a cylinder shape and cut to a specified length, after which one end of the cut filament bundle is alkali-treated with an aqueous sodium hydroxide solution, followed by water washing and drying.

One end of the filament is soaked in an alkali solution to hydrolyze the resin and thereby reduce weight, in order to form a region on this end which is tapered toward the tip and where projections by the glass particles manifest, and this region is referred to as the "tapered tip". The aqueous sodium hydroxide solution is siphoned to the cylindrical filament bundle by means of the capillary effect and the resin covering the projections of the glass particles is melted and removed, in order to form a region where the glass particles manifest over the entire surface of the body of the filament, and this region is referred to as the "body." Accordingly, the cosmetic brush bristle material proposed by the present invention has a region where projections are formed by the glass particles covered with the resin over the entire surface of the cosmetic filament, and also has regions covering the body and tapered tip, which are contiguous with the above region, where projections are formed by the glass particles over the entire surface.

And, the cosmetic brush proposed by the present invention is used to apply foundation and other cosmetic materials using the aforementioned regions having projections of the glass particles (body and tapered tip).

EXAMPLES

PTT (SORONA J2240 Semi-Dull by DuPont) was introduced to the first hopper of the extrusion machine and melted at 270° C., after which glass particles (of 1 to 2 μm in average particle size) were introduced, while being weighed, into the molten PTT from the second hopper, and the screw for which a sufficient agitation and kneading zone had been set was used to extrude and thereby manufacture pellets containing glass particles.

The pellets were dried at 110° C. and then introduced to a spinning machine where the pellets were melted at 270° C., kneaded at 250° C., extruded, and spun into a yarn from the spinning outlet, after which the yarn was drawn to 4 to 5 times longer through three stages of heating and drawing, to manufacture a 3-mill filament. Multiple filaments thus produced were bundled into a cylinder shape of 5 cm in diameter and cut to 6 cm in length. One end of the cut filament bundle was immersed in a 12 wt % aqueous sodium hydroxide solution at 120° C., and the non-immersed part of the immersed filament bundle was gradually raised over time, with the soak time adjusted over a range up to 120 minutes so that the tip of the filament bundle was hydrolyzed to a thickness of 10 to 25 μm, in order to form the tapered tip. The bundled filaments on the upper side of the soaked part of the filament bundle siphoned the aqueous sodium hydroxide solution by means of the capillary effect, after which the resin covering the projections formed by the glass particles on the filament surface was melted and removed to form the body. The width of this body can be changed as desired by adjusting the level of tightness of the filament bundle. Next, the obtained filament bundle was water-washed and dried to obtain a cosmetic brush bristle material.

When the tip of the 3-mill (76-μm) filament is tapered to 10 to 25 μm by means of alkali treatment, non-uniformly blended glass particles may cause the filament to break at a part where glass particles are not blended uniformly, and accordingly it is essential to knead the ingredients sufficiently at the time of blending.

Examples 1 to 8

PTT

The aforementioned manufacturing method was used to manufacture pellets containing glass particles at different glass particle contents and then melt and spin the pellets into a yarn, to manufacture the cosmetic brush bristle materials in Examples 1 to 8 below.

To be specific, filaments made of PTT blended with E glass particles by 0.3 percent by weight (Example 1), 0.4 percent by weight (Example 2), 0.5 percent by weight (Example 3) and 1.0 percent by weight (Example 4), respectively, were drawn to 4 to 5 times longer under the aforementioned conditions to manufacture filaments of 3 mills in fineness. Also, filaments blended with silver glass particles by 0.3 percent by weight (Example 5), 0.4 percent by weight (Example 6), 0.5 percent by weight (Example 7) and 1.0 percent by weight (Example 8), respectively, were drawn to 4 to 5 times longer under the aforementioned conditions to manufacture filaments of 3 mills in fineness. These filaments were each given the aforementioned alkali treatment to form the body and tapered tip.

Comparative Example 1

Comparative Example 1 represents a PTT filament not containing glass particles, which was given the aforementioned alkali treatment to form the body and tapered tip.

Examples 9 to 12

PBT

PBT (TORAYCOM 1401×06 by Toray) was introduced to the first hopper of the extrusion machine and melted at 270°

C., after which glass particles (of 1 to 2 μm in average particle size) were introduced, while being weighed, into the molten PBT from the second hopper, and the screw for which a sufficient agitation and kneading zone had been set was used to extrude and thereby manufacture pellets containing glass particles.

Each filament and its body and tapered tip was manufactured according to the same method used in Examples 1 to 8.

The aforementioned manufacturing method was used to manufacture pellets containing glass particles at different glass particle contents and then melt and spin the pellets into a yarn, to manufacture the cosmetic brush bristle materials in Examples 9 to 12 below.

To be specific, filaments made of PBT blended with silver glass particles by 0.3 percent by weight (Example 9), 0.4 percent by weight (Example 10), 0.5 percent by weight (Example 11) and 1.0 percent by weight (Example 12), respectively, were drawn to 4 to 5 times longer under the aforementioned conditions to manufacture filaments of 3 mills in fineness. These filaments were each given the aforementioned alkali treatment to form tapered tip.

Comparative Example 3

Comparative Example 3 shows a PBT filament not containing glass particles, which was given the aforementioned alkali treatment to form the body and tapered tip.

Next, ×1000 photographs capturing the surface of a horse hair and surface of each filament of the above cosmetic brush bristle material, all taken by a laser microscope (VK-Analyzer VK-8710 by Keyence), are shown in FIGS. 2 to 7. The photographs in FIGS. 3 and 5 show the surface of the filament before alkali treatment. Note that the surface shape of a horse hair characterized by projections is sometimes referred to as Comparative Example 2.

The photograph of the surface of an auxiliary horse hair in FIG. 2 shows many projections on the surface.

The photograph of the surface of the body of a filament constituted by PTT containing silver glass particles by 1 percent by weight, in FIG. 3, shows a small number of low projections on the surface.

The photograph of the surface of the alkali-treated body of a filament constituted by PTT containing silver glass particles by 1 percent by weight, in FIG. 4, shows many projections formed by silver glass particles on the surface.

The photograph of the surface of the body of a filament constituted by PTT containing silver glass particles by 0.5 percent by weight, in FIG. 5, shows a small number of low projections on the surface.

The photograph of the surface of the alkali-treated body of a filament constituted by PTT containing silver glass particles by 0.5 percent by weight, in FIG. 6, shows many projections formed by glass particles on the surface, but these projections are lower than the projections in FIG. 4.

The photograph of the surface of the alkali-treated tapered tip shown on the left side of FIG. 7 indicates that this tapered tip having projections formed by glass particles has a thickness of 10 to 25 μm as a result of hydrolysis of polyester resin and consequent reduction of weight, compared to the thickness of 76 μm of the non-alkali-treated body shown on the right side of FIG. 7.

The photographs in FIGS. 2 to 7 above show that, as a result of alkali treatment, many projections are formed by glass particles over the entire surface of the body of each cosmetic brush bristle material and also over the entire surface of the tapered tip, and that these projections are similar in shape to those found on the surface of the horse hair.

Additionally, the body surface of each of the cosmetic brush bristle materials in Examples 1 to 4 (PTT containing E glass), Examples 5 to 8 (PTT containing silver glass) and Examples 9 to 12 (PBT containing silver glass) was observed with a laser microscope (VK-Analyzer VK-8710 by Keyence) to measure the height and distribution of surface projections and thickness of the tapered tip. Table 1 lists the aforementioned heights, distributions and thicknesses of the cosmetic brush bristle materials containing E glass particles (PTT), Table 2 lists the aforementioned heights, distributions and thicknesses of the cosmetic brush bristle materials containing silver glass particles (PTT), and Table 3 lists the aforementioned heights, distributions and thicknesses of the cosmetic brush bristle materials containing silver glass particles (PBT).

TABLE 1

| | Comparative Example 1 | Example 1 | Example 2 | Example 3 | Example 4 | Comparative Example 2 |
|---|---|---|---|---|---|---|
| Content of E glass (% by weight) | 0.0 | 0.3 | 0.4 | 0.5 | 1.0 | Horse hair |
| Height of projections (μm) | — | 1.1 | 1.3 | 1.3 | 1.5 | 2.6 |
| Distribution of projections (number of projections per 50 $\mu m^2$) | — | 26 | 32 | 39 | 65 | 28 |
| Thickness of tip (μm) | 10~20 | 10~22 | 12~23 | 12~23 | 14~25 | 10~30 |
| Abnormal thickness (μm (%)) | — | — | — | — | — | — |

According to Table 1, the height of projections in Examples 1 to 4 (PTT) are 1.1 to 1.5 μm, while the height of projections on the horse hair is 2.6 μm, meaning that the height of projections in Examples 1 to 4 are approx. one-half that on the horse hair, respectively. Table 1 also shows that the distributions of projections in Examples 1 to 4 are 26 to 65 projections per 50 $\mu m^2$, while the distribution of projections on the horse hair is 28 projections per 50 $\mu m^2$, where, specifically, the distributions of projections in Examples 1 and 2 are similar to the distribution of projections on the horse hair, and in Examples 3 and 4, the distribution of projections on the PTT hair increases as the content of E glass increases.

Furthermore, Table 1 shows that the thickness of the tips in Examples 1 to 4 (PTT) are 10 to 25 μm, while the thickness of the tip of the horse hair is 10 to 30 μm, meaning that the thickness of the tips in Examples 1 to 4 (PTT) is similar to the thickness of the tip of the horse hair.

TABLE 2

| | Comparative Example 1 | Example 5 | Example 6 | Example 7 | Example 8 | Comparative Example 2 |
|---|---|---|---|---|---|---|
| Content of silver glass (% by weight) | 0.0 | 0.3 | 0.4 | 0.5 | 1.0 | Horse hair |
| Height of projections (μm) | — | 1.1 | 1.2 | 1.3 | 1.6 | 2.6 |
| Distribution of projections (number of projections per 50 $\mu m^2$) | — | 21 | 27 | 33 | 64 | 28 |
| Thickness of tip (μm) | 10~20 | 10~22 | 13~23 | 13~23 | 15~25 | 10~30 |
| Abnormal thickness (μm (%)) | — | | | | 45 (15%) | — |
| Bacteriostatic activity | — | 4.2 | 4.5 | 4.7 | 5.6 | — |

It is clear from Table 2 that, because the height and distribution of projections and thickness of tapered parts in Examples 5 to 8 (PTT) are roughly the same, the cosmetic brush bristle materials containing E glass particles and silver glass particles have roughly the same height, distribution, and thickness shape.

However, Example 8 where the aforementioned content is 1.0 percent by weight had a 15% probability of the aforementioned tip having a thickness of 45 μm. This thickness of the tip is at least twice the normal thickness and thus abnormal. Because the fineness of the filament is 3 mills, its diameter is 76 μm and therefore the above thickness of 45 μm of the tip formed by alkali treatment is abnormal, and any cosmetic brush whose filaments include those of such thickness has a serious drawback as the thick bristles will irritate the skin.

Such abnormal thickness occurs in a region where glass particles are not contained uniformly, which in turn results from applying alkali treatment when glass particles are not uniformly contained during the course of screw-kneading of the material after glass particles have been introduced from the second hopper. Accordingly, the aforementioned incidence of abnormal thickness will drop if consideration is given to the kneading conditions of glass particles to achieve uniform distribution of glass particles.

The bacteriostatic activities in Table 2 represent the values obtained from an antibacterial test of Staphylococcus aureus based on the standard of JIS L 1902-1998 (ISO 20743).

According to the test results, the bacteriostatic activities measured on Staphylococcus aureus are in a range of 4 to 6, indicating excellent antibacterial property. The aforementioned standard specifies that a bacteriostatic activity of 2.2 or greater represents antibacterial/deodorizing performance beyond the standard, and the aforementioned bacteriostatic activity range of 4 to 6 is associated with much higher performance.

One problem the users of cosmetic brushes want to see solved as soon as possible is that when the brush contacts the skin, resident bacteria on the skin and aquatic bacteria attach to the brush and the attached bacteria grow on the brush to give off unpleasant smell. Such smell is no longer recognized if 99% of the bacteria are killed. The state where 99% of the bacteria are killed represents a bacteriostatic activity of 2.2. The cosmetic brush bristle materials in Examples 5 to 8 have a bacteriostatic activity ranging from 4 to 6, indicating that the bacteria can be killed more quickly than when the bacteriostatic activity is 2.2 and consequently production of smell can be prevented early. The cosmetic brush bristle materials in Examples 5 to 8 have silver glass projections of 1.0 to 1.5 μm present over the entire surface at their tip, at a distribution density of 21 to 64 projections per 50 $\mu m^2$, which translates to excellent antibacterial property and deodorizing property against resident bacteria in the skin and aquatic bacteria.

TABLE 3

| | Comparative Example 3 | Example 9 | Example 10 | Example 11 | Example 12 | Comparative Example 2 |
|---|---|---|---|---|---|---|
| Content of silver glass (% by weight) | 0.0 | 0.3 | 0.4 | 0.5 | 1.0 | Horse hair |
| Height of projections (μm) | — | 1.1 | 1.1 | 1.2 | 1.4 | 2.6 |
| Distribution of projections (number of projections per 50 $\mu m^2$) | — | 24 | 30 | 35 | 63 | 28 |
| Thickness of tip (μm) | 10~20 | 10~22 | 12~23 | 12~23 | 14~25 | 10~30 |
| Abnormal thickness (μm (%)) | — | | | | 40 (2%) | — |
| Bacteriostatic activity | — | 4.0 | 4.5 | 4.6 | 5.5 | — |

Examples 9 to 12 represent cosmetic brush bristle materials constituted by PBT containing silver glass by 0.3, 0.4, 0.5 and 1.0 percent by weight, respectively.

Since the height and distribution of projections and thickness of tips in Examples 9 to 12 (PBT) as shown in Table 3 are roughly the same as those in Examples 5 to 8 (PTT), it is suggested that both the cosmetic brush bristle materials constituted by PTT containing silver glass particles and cosmetic brush bristle materials constituted by PBT containing silver glass particles have roughly the same height, distribution and thickness shape.

It is clear from the foregoing that, regardless of whether their polyester resin is PTT or PBT, cosmetic brush bristle materials constituted by PTT or PBT containing glass particles have roughly the same height and distribution of projections and thickness at the tip.

Moreover, since the cosmetic brush bristle materials in Examples 9 to 12 have a bacteriostatic activity ranging from 4 to 6, the bacteria can be killed more quickly than when the bacteriostatic activity is 2.2 and consequently production of smell can be prevented early.

TABLE 4

| | Comparative Example 4 | Example 13 | Example 14 | Example 15 | Example 16 | Comparative Example 2 |
|---|---|---|---|---|---|---|
| Content of silver glass (% by weight) | 0.0 | 0.3 | 0.4 | 0.5 | 1.0 | Horse hair |
| Height of projections (μm) | — | 1.1 | 1.1 | 1.3 | 1.5 | 2.6 |
| Distribution of projections (number of projections per 50 $\mu m^2$) | — | 25 | 32 | 37 | 65 | 28 |
| Thickness of tip (μm) | 10~20 | 10~22 | 12~23 | 12~23 | 14~25 | 10~30 |
| Abnormal thickness (μm (%)) | — | | | | 40 (2%) | — |
| Bacteriostatic activity | — | 4.0 | 4.4 | 4.7 | 5.5 | — |

Examples 13 to 16 represent cosmetic brush bristle materials constituted by a mixed resin of 60 percent by weight of PTT and 40 percent by weight of PBT, containing silver glass by 0.3, 0.4, 0.5 and 1.0 percent by weight, respectively.

Since the height and distribution of projections and thickness of tips in Examples 13 to 16 (mixed resin of PTT and PBT) as shown in Table 4 are roughly the same as those in Examples 1 to 8 (PTT) and Examples 9 to 12 (PBT), it is suggested that both the cosmetic brush bristle materials constituted by PTT or PBT containing silver glass and cosmetic brush bristle materials constituted by PTT and PBT containing silver glass have roughly the same height, distribution and thickness shape. It is clear from the foregoing that, regardless of whether their polyester resin is PTT or PBT or a mixture thereof, cosmetic brush bristle materials containing glass particles have roughly the same height and distribution of projections and thickness at the tip.

Moreover, since the cosmetic brush bristle materials in Examples 13 to 16 have a bacteriostatic activity ranging from 4 to 6, the bacteria can be killed more quickly than when the bacteriostatic activity is 2.2 and consequently production of smell can be prevented early.

(Use Test Results)

The results of use tests conducted by five subjects on liquid foundation brushes and powder brushes using the bristle materials blended with silver glass in Examples 5 to 8 (PTT) and hair in Comparative Examples 1 and 2, were evaluated on a scale of 1 to 5. The evaluation results of liquid foundation brushes are shown in Table 5, while the evaluation results of powder brushes are shown in Table 6.

Evaluation was made on a scale of 1 to 5, where 5 represents "Very good," 4 represents "Good," 3 represents "Average," 2 represents "Bad" and 1 represents "Very bad."

Similarly, Table 7 lists the evaluation results of use tests conducted by five subjects on powder brushes using silver-glass blended materials in Examples 9 to 12 (PBT).

TABLE 5

| | Comparative Example 1 | Example 5 | Example 6 | Example 7 | Example 8 | Comparative Example 2 |
|---|---|---|---|---|---|---|
| Content of silver glass (% by weight) | 0.0 | 0.3 | 0.4 | 0.5 | 1.0 | Horse hair |
| Loading property | 3 | 4 | 4 | 4 | 5 | 5 |
| Transfer property | 3 | 4 | 4 | 5 | 5 | 5 |
| Feeling during use | 3 | 5 | 5 | 5 | 2-5 | 5 |

TABLE 6

| | Comparative Example 1 | Example 5 | Example 6 | Example 7 | Example 8 | Comparative Example 2 |
|---|---|---|---|---|---|---|
| Content of silver glass (% by weight) | 0.0 | 0.3 | 0.4 | 0.5 | 1.0 | Horse hair |
| Loading property | 3 | 4 | 4 | 4 | 5 | 5 |
| Transfer property | 3 | 4 | 4 | 5 | 5 | 5 |
| Feeling during use | 3 | 5 | 5 | 5 | 2-5 | 5 |

TABLE 7

| | Comparative Example 3 | Example 9 | Example 10 | Example 11 | Example 12 | Comparative Example 2 |
|---|---|---|---|---|---|---|
| Content of silver glass (% by weight) | 0.0 | 0.3 | 0.4 | 0.5 | 1.0 | Horse hair |
| Loading property | 3 | 4 | 4 | 4 | 5 | 5 |
| Transfer property | 3 | 4 | 4 | 5 | 5 | 5 |
| Feeling of use | 3 | 4 | 4 | 4 | 2-4 | 5 |

Compared to the PTT100% brush in Comparative Example 1 or PBT100% brush in Comparative Example 3, both the liquid and powder brushes in the Examples present clearly better loading property and transfer property with respect to cosmetic materials, and offer excellent functionality and touch when used.

The poor touch of the brushes using materials blended with 1.0 percent by weight of silver glass is due to some of the filaments being broken at the tapered tip as a result of alkali treatment and consequently having an abnormal thickness at the tip, which indicates that the blending ratio of glass particles is limited to 1.0 percent by weight even with increased kneading when glass particles are blended.

(Action Mechanism of Projection Forming)

Here, the action mechanism of how a filament produced by melting and spinning pellets containing glass particles into a yarn and then drawing the yarn by 4 to 5 times has projections formed over its entire surface by glass particles covered with polyester resin, and how projections are formed on the surface of the tip when this filament is alkali-treated, is examined.

While the thermal conductivities of glass particles (silica glass, silver glass, and E glass) are 1.38 to 1.50 W/mK, the thermal conductivity of polyester resin (PTT or PBT) is 5.1 to 5.6 times lower at 0.27 W/mK, which means that 5 to 7 times more heat conducts through glass particles than through polyester resin.

Incidentally, it was mentioned earlier that concaves are formed on the surface of the cosmetic brush bristle material containing inorganic powder (silver zeolite) as described in Patent Literature 1. While the thermal conductivity of PBT constituting this brush bristle material is 0.27 W/mK, the thermal conductivity of silver zeolite is 0.58 W/mK, representing only a small difference between the two.

In the drawing process where the resin containing glass particles that has been extruded from the spinning outlet is drawn to 4 to 5 times longer through three stages of heating and drawing, the glass particles present on the surface of this resin are heated at a thermal conductivity around five times the thermal conductivity of the resin, and consequently the resin around the glass particles is heated and softens more quickly than the rest of the resin. This quickly heated and softened resin is drawn first and the glass particles are lifted to form projections. Although the surface of these projections is covered with resin, the resin is subsequently removed by alkali treatment and the height of projections becomes more prominent as a result. It is important that the content of glass particles is in a range of 0.3 to 1.0 percent by weight. If the content of glass particles is 0.3 percent by weight or less, the height of projections becomes 1.0 μm or less, which is not desirable. If the content of glass particles is 1.0 percent by weight or more, on the other hand, some of the filaments will break along the tapered tip as a result of alkali treatment and consequently have an abnormal thickness at the tip, which is not desirable as it leads to a poor feeling during use of the cosmetic brush.

On the other hand, the cosmetic brush bristle material containing silver zeolite as described in Patent Literature 1 is such that, as a filament is spun and heated/extended in the drawing process where the filament is drawn to 4 to 5 times longer through three stages of heating and drawing, the molecular chain of the PBT fiber is oriented in the axial direction of the fiber and the cross-section area of the fiber decreases as a result. This is probably explained by the application of tension in the axial direction of the fiber in this drawing process, and consequent action of contracting force toward the center of the fiber section, because, as the thermal conductivity of silver zeolite is not very different from that of PBT, this contracting force causes silver zeolite to sink and allows concaves to be formed on the filament surface.

(Cosmetic Brushes in Examples and Horse-hair Cosmetic Brush)

The cosmetic brush bristle materials in the Examples have the same shape as horse hair in that many projections are formed by glass particles on the surface. Also from the measured height and distribution of projections and thickness of tips in Tables 1 to 4, these projections have a height of approx. one-half the height of projections on horse hair, as well as a distribution of projections similar to or greater than the distribution of projections on horse hair, and the thickness of tips are similar to the thickness of tip of the horse hair. Although the bristle materials in the Examples have a height of projections corresponding to approx. one-half the height of projections on horse hair, their distribution of projections and thickness of tips are similar. Additionally, the results in Tables 5 to 7 indicate that the liquid foundation brushes and powder brushes that represent cosmetic brushes using these bristle materials have loading property and transfer property with respect to cosmetic materials and feeling of use very similar to what is expected from horse hair, and therefore they can be used as substitutes for horse-hair cosmetic brushes. Furthermore, the cosmetic brushes containing silver glass particles have a bacteriostatic activity ranging from 4 to 6 because their projections are formed by silver glass, and consequently demonstrate excellent antibacterial property and deodorizing property.

What is claimed is:

1. A cosmetic brush bristle material having a body and tapered tip formed by alkali treatment on one end of a cosmetic filament constituted by polyester resin containing inorganic particles, wherein:

the polyester resin is polytrimethylene terephthalate and/or polybutylene terephthalate;

the polyester resin contains silver glass particles of 1 to 2 μm in average particle size by 0.4 to 0.5 percent by weight as the inorganic particles;

a thermal conductivity of the silver glass particles is in a range of 5 to 7 times that of the resin; and the cosmetic filament has three regions along an axial direction of the cosmetic filament, the three regions being:

a first region where projections are formed over an entire surface of the first region of the filament by the silver glass particles covered with the resin, a second region corresponding to the body which is not a part of the tapered tip, closer to the tapered tip than is the first region, and contiguous with the first region, where projections are formed by the silver glass particles which manifest over the entire surface of the second region of the filament as a result of melting and removing the resin covering the projections of the glass particles, wherein the projections formed over the entire surface of the body have a height of 1.1 to 1.3 μm, wherein a distribution density of projections on the body of the cosmetic brush bristle material is in a range of 20 to 65 projections per 50 $\mu m^2$, and a third region corresponding to the tapered tip contiguous with the second region and gradually tapered toward an end of the tapered tip, where projections are formed by the silver glass particles which manifest over the entire surface of the third region of the filament as a result of melting and removing the resin covering the projections of the glass particles, wherein a diameter of the tapered tip is in a range of 10 to 25 μm.

2. A cosmetic brush bristle material according to claim 1, wherein the thermal conductivity of the silver glass particle is 1.38 to 1.50 W/mK.

3. A cosmetic brush bristle material according to claim 1, wherein a fineness of the cosmetic filament is 2 to 4 mils.

4. A cosmetic brush bristle material according to claim 1, wherein a bacteriostatic activity of the cosmetic brush bristle material whose glass particles are made of silver glass in a range of 4 to 6.

5. A cosmetic brush that uses a cosmetic brush bristle material having a body and tapered tip formed by alkali treatment on one end of a cosmetic filament constituted by polyester resin containing inorganic particles, wherein:

the polyester resin is polytrimethylene terephthalate and/or polybutylene terephthalate;

the polyester resin contains silver glass particles of 1 to 2 μm in a average particle size by 0.4 to 0.5 percent by weight as the inorganic particles;

a thermal conductivity of the silver glass particle is in a range of 5 to 7 times that of the resin;

the cosmetic filament has three regions along an axial direction of the cosmetic filament, the three regions being:

a first region where projections are formed over an entire surface of the first region of the filament by the silver glass particles covered with the resin, a second region corresponding to the body which is not a part of the tapered tip, closer to the tapered tip than is the first region, and contiguous with the first region, where projections are formed by the silver glass particles which manifest over the entire surface of the second region of the filament as a result of melting and removing the resin covering the projections of the glass particles, wherein the projections formed over the entire surface of the body have a height of 1.1 to 1.3 μm, wherein a distribution density of projections on the body of the cosmetic brush bristle material is in a range of 20 to 65 projections per 50 $\mu m^2$, and a third region corresponding to the tapered tip contiguous with the second region and gradually tapered toward an end of the tapered tip, where projections are formed by the silver glass particles which manifest over the entire surface of the third region of the filament as a result of melting and removing the resin covering the projections of the glass particles, wherein a diameter of the tapered tip is in a range of 10 to 25 μm; and the cosmetic brush bristle material used for the brush in which the first and second regions covering the body and the third region covering the tapered tip are used to apply cosmetic materials is applied to a foundation brush, powder brush, eye shadow brush, lip brush or shadow brush.

6. A cosmetic brush according to claim 5, wherein the thermal conductivity of the silver glass particles is 1.38 to 1.5 W/mK.

7. A cosmetic brush according to claim 5, wherein a fineness of the cosmetic filament is 2 to 4 mils.

8. A cosmetic brush according to claim 5, wherein a bacteriostatic activity of the cosmetic brush bristle material whose glass particles are made of silver glass is in a range of 4 to 6.

9. A cosmetic brush bristle material according to claim 1, wherein the polyester resin consists of a blend of polytrimethylene terephthalate and polybutylene terephthalate.

10. A cosmetic brush bristle material according to claim 5, wherein the polyester resin consists of a blend of polytrimethylene terephthalate and polybutylene terephthalate.

* * * * *